US009366058B2

(12) United States Patent
Zhao et al.

(10) Patent No.: US 9,366,058 B2
(45) Date of Patent: Jun. 14, 2016

(54) FASTENING DEVICES FOR EXPLOSION-PROOF ENCLOSURES

(71) Applicants: Yabin Zhao, Liverpool, NY (US); Joseph Michael Manahan, Manilus, NY (US)

(72) Inventors: Yabin Zhao, Liverpool, NY (US); Joseph Michael Manahan, Manilus, NY (US)

(73) Assignee: Cooper Technologies Company, Houston, TX (US)

( * ) Notice: Subject to any disclaimer, the term of this patent is extended or adjusted under 35 U.S.C. 154(b) by 144 days.

(21) Appl. No.: 14/025,896

(22) Filed: Sep. 13, 2013

(65) Prior Publication Data

US 2015/0076841 A1 Mar. 19, 2015

(51) Int. Cl.
*B65D 45/00* (2006.01)
*E05B 65/00* (2006.01)
(Continued)

(52) U.S. Cl.
CPC ..... *E05B 65/00* (2013.01); *B65D 43/0225* (2013.01); *B65D 43/165* (2013.01); *B65D 43/22* (2013.01); *E05C 19/00* (2013.01);
(Continued)

(58) Field of Classification Search
CPC ..... E05C 19/00; B65D 43/06; B65D 45/16; B65D 45/24; B65D 43/0225; B65D 43/22; B65D 43/165; B65D 2543/00092; B65D 2543/0049; B65D 2543/00277; B65D 2543/00546; Y10S 292/11; Y10T 403/7052; Y10T 292/225; E05B 65/00; F42D 5/045
USPC ..... 292/1, 137, 138, 256, 251, 256.5, 292/256.71, 256.73, 251.75, 257, 300, 301, 292/DIG. 11, DIG. 65; 403/320, 350, 409.1, 403/DIG. 8
See application file for complete search history.

(56) References Cited

U.S. PATENT DOCUMENTS 628,297 A * 7/1899 Barr ..... 411/166
896,145 A 8/1908 Payne
(Continued)

FOREIGN PATENT DOCUMENTS

| | | |
|---|---|---|
| CN | 102791168 | 11/2012 |
| EP | 0346290 | 12/1989 |
| WO | 2011084152 | 7/2011 |

OTHER PUBLICATIONS

E. Kamaganova, Search and Written Opinion issued in International Application No. PCT/US2014/055237, completion date Nov. 27, 2014, 7 pages, Federal Institute of Industrial Property, Moscow, Russia.

(Continued)

*Primary Examiner* — Kristina Fulton
*Assistant Examiner* — Christine M Mills
(74) *Attorney, Agent, or Firm* — King & Spalding LLP

(57) ABSTRACT

An enclosure can include a top enclosure portion having a top flange and a first top engagement feature. The enclosure can also include a bottom enclosure portion mechanically coupled to the top enclosure portion, where the bottom enclosure portion has a bottom flange that mechanically couples to the top flange and a first bottom engagement feature that mechanically couples to the first top engagement feature. The enclosure can further include a first fastening device mechanically and movably coupled to the first top engagement feature and the first bottom engagement feature. The first fastening device, in an engaged position, can maintain a flame path between the top flange and the bottom flange. The first fastening device, in a disengaged position, can fail to maintain a flame path between the top flange and the bottom flange.

19 Claims, 9 Drawing Sheets

(51) Int. Cl.

| | |
|---|---|
| ***E05C 19/00*** | (2006.01) |
| ***B65D 43/02*** | (2006.01) |
| ***B65D 43/16*** | (2006.01) |
| ***B65D 43/22*** | (2006.01) |
| ***F42D 5/045*** | (2006.01) |

(52) U.S. Cl.

CPC ..... *F42D 5/045* (2013.01); *B65D 2543/0049* (2013.01); *B65D 2543/00092* (2013.01); *B65D 2543/00277* (2013.01); *B65D 2543/00546* (2013.01); *Y10T 292/225* (2015.04)

(56) References Cited

U.S. PATENT DOCUMENTS

| | | | | | |
|---|---|---|---|---|---|
| 1,452,492 | A | | 4/1923 | Carpenter | |
| 1,482,049 | A | | 1/1924 | Swanson | |
| 1,836,949 | A | | 12/1931 | Balough | |
| 2,050,854 | A | | 8/1936 | Olley | |
| 2,225,945 | A | | 12/1940 | Appleton | |
| 2,360,826 | A | | 10/1944 | Cherry | |
| 2,397,382 | A | * | 3/1946 | Smith | 403/350 |
| 2,643,904 | A | | 6/1953 | Wehmanen | |
| 2,762,473 | A | * | 9/1956 | Swerdlow | 49/395 |
| 2,943,661 | A | | 7/1960 | Stern | |
| 3,349,947 | A | * | 10/1967 | Zumwalt | 220/327 |
| 3,360,155 | A | | 12/1967 | Colonna | |
| 3,362,573 | A | | 1/1968 | Wales, Jr. | |
| 3,416,823 | A | | 12/1968 | Auer | |
| 3,419,227 | A | * | 12/1968 | McCarthy et al. | 242/571.7 |
| 3,514,009 | A | | 5/1970 | Emery et al. | |
| 3,541,917 | A | | 11/1970 | Vandouwen et al. | |
| 3,582,535 | A | | 6/1971 | Appleton | |
| 3,724,706 | A | | 4/1973 | Slocum | |
| 3,743,800 | A | | 7/1973 | Appleton et al. | |
| 3,974,933 | A | * | 8/1976 | Toth | H02G 3/088 174/50 |
| 4,059,199 | A | | 11/1977 | Quaney | |
| 4,157,146 | A | | 6/1979 | Svenson | |
| 4,233,697 | A | | 11/1980 | Cornwall | |
| 4,497,418 | A | | 2/1985 | Nunlist | |
| 4,664,281 | A | * | 5/1987 | Falk et al. | 220/3.8 |
| 4,729,584 | A | | 3/1988 | Beckerer, Jr. | |
| 4,902,046 | A | | 2/1990 | Maloberti | |
| 5,104,141 | A | * | 4/1992 | Grove et al. | 280/86.753 |
| 5,346,090 | A | | 9/1994 | Purohit et al. | |
| 5,413,441 | A | * | 5/1995 | Heminger et al. | 411/55 |
| 5,534,664 | A | * | 7/1996 | Fearing, Jr. | F21V 19/04 174/50 |
| 5,657,892 | A | | 8/1997 | Bolli et al. | |
| 5,785,449 | A | | 7/1998 | Dibene | |
| 5,888,140 | A | | 3/1999 | Klingler et al. | |
| 6,302,416 | B1 | * | 10/2001 | Schmack | 280/93.512 |
| 6,331,674 | B1 | * | 12/2001 | Zolock et al. | 174/60 |
| 6,754,067 | B2 | | 6/2004 | Turner et al. | |
| 6,882,523 | B2 | | 4/2005 | Turner et al. | |
| 6,938,385 | B2 | | 9/2005 | Lind | |
| 6,979,777 | B2 | | 12/2005 | Marcou et al. | |
| 7,124,908 | B2 | * | 10/2006 | Sanders | 220/581 |
| 7,341,144 | B2 | * | 3/2008 | Tajiri | B65D 43/165 16/386 |
| 7,877,948 | B2 | | 2/2011 | Davies | |
| 8,227,692 | B2 | | 7/2012 | Dahlgren et al. | |
| 2001/0022926 | A1 | | 9/2001 | Kitayama et al. | |
| 2010/0147854 | A1 | * | 6/2010 | Fauveau | 220/327 |
| 2010/0178887 | A1 | * | 7/2010 | Millam | 455/128 |
| 2011/0131898 | A1 | | 6/2011 | Nies et al. | |

OTHER PUBLICATIONS

E. Kamaganova, Search and Written Opinion issued in International Application No. PCT/US2014/055234, completion date Nov. 27, 2014, 6 pages, Federal Institute of Industrial Property, Moscow, Russia.

* cited by examiner

FASTENING DEVICES FOR EXPLOSION-PROOF ENCLOSURES

CROSS-REFERENCE TO RELATED APPLICATION

The present application is related to U.S. patent application Ser. No. 13/794,402, entitled "Fastening Devices for Explosion-Proof Enclosures," filed with the U.S. Patent and Trademark Office on Mar. 11, 2013, and whose entire contents are hereby incorporated herein by reference.

The present application is also related to U.S. patent application Ser. No. 14/025,992 titled "Fastening Devices for Explosion-Proof Enclosures," which is being filed concurrently with the U.S. Patent and Trademark Office.

TECHNICAL FIELD

The present disclosure relates generally to explosion-proof enclosures, and more particularly to systems, methods, and devices for securing a cover of an explosion-proof enclosure to a body of the explosion-proof enclosure.

BACKGROUND

Explosion-proof receptacle housings and enclosure systems are used in many different industrial applications. Such explosion-proof receptacle housing and enclosure systems may be used, for example, in military applications, onboard ships, assembly plants, power plants, oil refineries, petrochemical plants, and other harsh environments. At times, the equipment located inside such explosion-proof receptacle housing and enclosure systems is used to control motors and other industrial equipment.

In order for an explosion-proof enclosure to meet certain standards and requirements, the cover of the enclosure must be sealed to the body of the enclosure within certain tolerances. Often, this requires a large number (30 or more) of bolts to be tightened. Consequently, securing all of the bolts at the appropriate torque is a very time-consuming process. In addition, removing all of the bolts to access one or more components inside the explosion-proof enclosure is a time-consuming process. Further, if all of the bolts are not reinserted and properly torqued, insufficient sealing can result, thereby creating a point of environmental ingress and/or loss of explosion-proof integrity.

SUMMARY

In general, in one aspect, the disclosure relates to an enclosure. The enclosure can include a top enclosure portion having a top flange and a first top engagement feature. The enclosure can also include a bottom enclosure portion mechanically coupled to the top enclosure portion, where the bottom enclosure portion has a bottom flange that mechanically couples to the top flange and a first bottom engagement feature that mechanically couples to the first top engagement feature. The enclosure can further include a first fastening device mechanically and movably coupled to the first top engagement feature and the first bottom engagement feature. The first fastening device, in an engaged position, can maintain a flame path between the top flange and the bottom flange. The first fastening device, in a disengaged position, can fail to maintain a flame path between the top flange and the bottom flange.

In another aspect, the disclosure can generally relate to an enclosure system. The enclosure system can include a first enclosure, a second enclosure, and a joining features. The first enclosure can include a first top enclosure portion having a first top flange and a first top engagement feature. The first enclosure can also include a first bottom enclosure portion mechanically coupled to the top enclosure portion, where the first bottom enclosure portion has a first bottom flange that mechanically couples to the first top flange and a first bottom engagement feature that mechanically couples to the first top engagement feature. The first enclosure can further include a first fastening device mechanically and movably coupled to the first top engagement feature and the first bottom engagement feature. The first fastening device, in an engaged position, can maintain a first flame path between the first top flange and the first bottom flange. The first fastening device, in a disengaged position, can fail to maintain a first flame path between the first top flange and the first bottom flange. The second enclosure can include a second top enclosure portion having a second top flange and a second top engagement feature. The second enclosure can also include a second bottom enclosure portion mechanically coupled to the second top enclosure portion, where the second bottom enclosure portion has a second bottom flange that mechanically couples to the second top flange and a second bottom engagement feature that mechanically couples to the second top engagement feature. The second enclosure can further include a second fastening device mechanically and movably coupled to the second top engagement feature and the second bottom engagement feature. The second fastening device, in an engaged position, can maintain a second flame path between the second top flange and the second bottom flange. The second fastening device, in a disengaged position, can fail to maintain a second flame path between the second top flange and the second bottom flange. The joining feature can be mechanically coupled to the first enclosure and the second enclosure, where the joining feature forms a third flame path with the first enclosure and a fourth flame path with the second enclosure.

In another aspect, the disclosure can generally relate to an enclosure. The enclosure can include an enclosure cover having a cover flange and at least one cover portion of an engagement feature, where each of the at least one cover portion has a first base and a first extension. The enclosure can also include an enclosure body mechanically coupled to the enclosure cover, where the enclosure body has a body flange that mechanically couples to the cover flange, where the enclosure body further includes at least one body portion of the engagement feature that mechanically couples to the at least one cover portion, where each of the at least one body portion has a second base and a second extension. The engagement feature can be in an engaged position when the first extension abuts the second extension, where the engagement feature in the engaged position maintains a flame path between the top flange and the bottom flange. The first fastening device, in a disengaged position, can fail to maintain a flame path between the top flange and the bottom flange.

These and other aspects, objects, features, and embodiments will be apparent from the following description and the appended claims.

BRIEF DESCRIPTION OF THE DRAWINGS

The drawings illustrate only example embodiments of fastening devices for explosion-proof enclosures and are therefore not to be considered limiting of its scope, as fastening devices for explosion-proof enclosures may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1A:
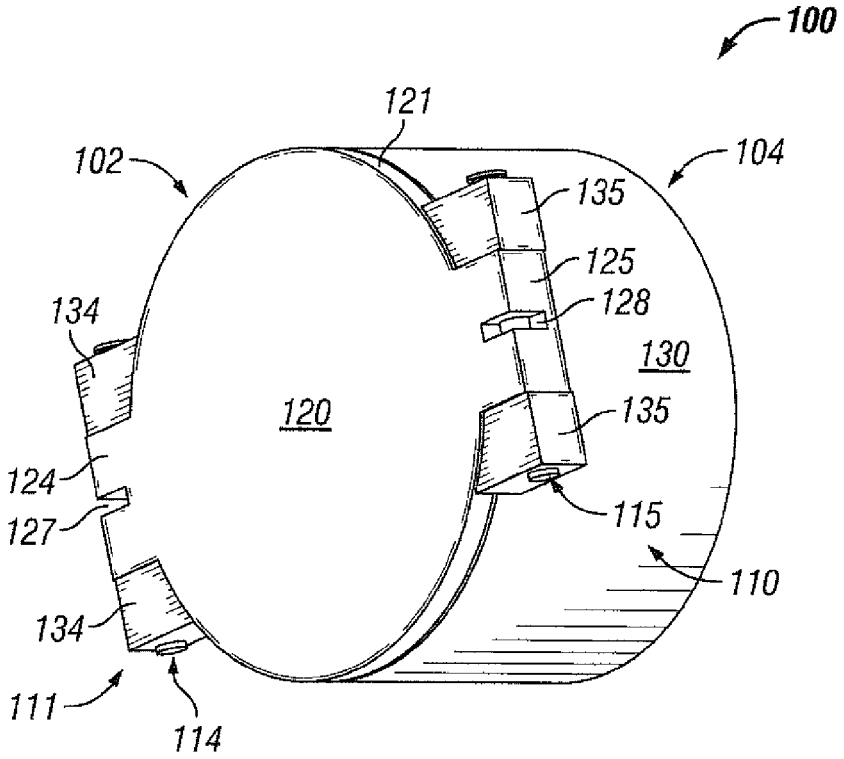
FIGS. 1A-1D show various views of an explosion-proof enclosure with example fastening features in accordance with certain example embodiments.

The example embodiments discussed herein are directed to systems, apparatuses, and methods of fastening a cover of an explosion-proof enclosure to a body of the explosion-proof enclosure. While the example embodiments discussed herein are with reference to explosion-proof enclosures, other types of non-explosion-proof enclosures (e.g., junction boxes, control panels, lighting panels, motor control centers, switchgear cabinets, relay cabinets) or any other type of enclosure (e.g., hazardous enclosure) may be used in conjunction with example embodiments of fastening devices.

As used herein, the cover and the body of an enclosure can be referred to as enclosure portions (e.g., top enclosure portion, bottom enclosure portion). Further, while example fastening devices are shown in the accompanying figures as being mechanically coupled to the cover and the body of an enclosure, example fastening devices can, additionally or alternatively, be mechanically coupled to the cover or to the body of the enclosure.

In one or more example embodiments, an explosion-proof enclosure (also sometimes called a flame-proof enclosure and a hazardous location enclosure) is an enclosure that is configured to contain an explosion that originates inside the enclosure. Further, the explosion-proof enclosure is configured to allow gases from inside the enclosure to escape across joints of the enclosure and cool as the gases exit the explosion-proof enclosure. The joints are also known as flame paths and exist where two surfaces meet and provide an uninterrupted path, from inside the explosion-proof enclosure toward the outside of the explosion-proof enclosure, along which one or more gases may travel. A joint may be a mating of any two or more surfaces. Each surface may be any type of surface, including but not limited to a flat surface, a threaded surface, a rabbet surface, and a serrated surface. As used herein, an explosion-proof enclosure can be an enclosure that is suitable for potentially explosive environments.

In one or more example embodiments, an explosion-proof enclosure is subject to meeting certain standards and/or requirements. For example, NEMA sets standards with which an enclosure must comply in order to qualify as an explosion-proof enclosure. Specifically, NEMA Type 7, Type 8, Type 9, and Type 10 enclosures set standards with which an explosion-proof enclosure within a hazardous location must comply. For example, a NEMA Type 7 standard applies to enclosures constructed for indoor use in certain hazardous locations. Hazardous locations may be defined by one or more of a number of authorities, including but not limited to the National Electric Code (e.g., Class I, Division 1) and Underwriters' Laboratories, Inc. (UL) (e.g., UL 1203). For example, a Class I hazardous area under the National Electric Code is an area in which flammable gases or vapors may be present in the air in sufficient quantities to be explosive.

As a specific example, NEMA standards for an explosion-proof enclosure of a certain size (e.g., 100 $cm^3$) or range of sizes may require that in a Group B, Division 1 area, any flame path of an explosion-proof enclosure must be at least 1 inch long (continuous and without interruption), and the gap between the surfaces cannot exceed 0.0015 inches. While flame paths and other such aspects of explosion-proof enclosures are well known to those of ordinary skill in the art, background information is provided, for example, by NEMA.

Some standards also require that one or more tools are used to open an explosion-proof enclosure. Example embodiments described herein can require the use of a tool, whether custom made or standard, to disengage the fastening device and open the explosion-proof enclosure. Each example fastening device (or components thereof) can be made from one or more of a number of suitable materials, including but not limited to stainless steel, plastic, aluminum, ceramic, rubber, and iron.

Example enclosures described herein can be exposed to one or more environments (e.g., hazardous, corrosive, high temperature, high humidity) that can cause the enclosure cover and the enclosure body to become fused together to some extent. In such a case, example cover release mechanisms can be used to assist in prying apart the enclosure cover from the enclosure body. For example, such a cover release mechanism can be useful when oxidation has formed between the cover flange and the body flange. In such a case, an improper method of prying apart the enclosure cover and the enclosure body can result in damage (e.g., scoring, pitting, gouging) to the cover flange and/or the body flange. Examples of cover release mechanisms can be found in U.S. patent application Ser. No. 13/794,433 entitled "Cover Release Mechanisms for Enclosures," the entire contents of which are hereby incorporated by reference.

Example embodiments of fastening devices for explosion-proof enclosures will be described more fully hereinafter with reference to the accompanying drawings, in which example embodiments of fastening devices for explosion-proof enclosures are shown. Fastening devices for explosion-proof enclosures may, however, be embodied in many different forms and should not be construed as limited to the example embodiments set forth herein. Rather, these example embodiments are provided so that this disclosure will be thorough and complete, and will fully convey the scope of fastening devices for explosion-proof enclosures to those or ordinary skill in the art. Like, but not necessarily the same, elements (also sometimes called components) in the various figures are denoted by like reference numerals for consistency. Terms such as "first," "second," "top," "bottom," "width," "height," "left," and "right" are used merely to distinguish one component (or part of a component) from another. Such terms are not meant to denote a preference or a particular orientation.

Figure 1B:
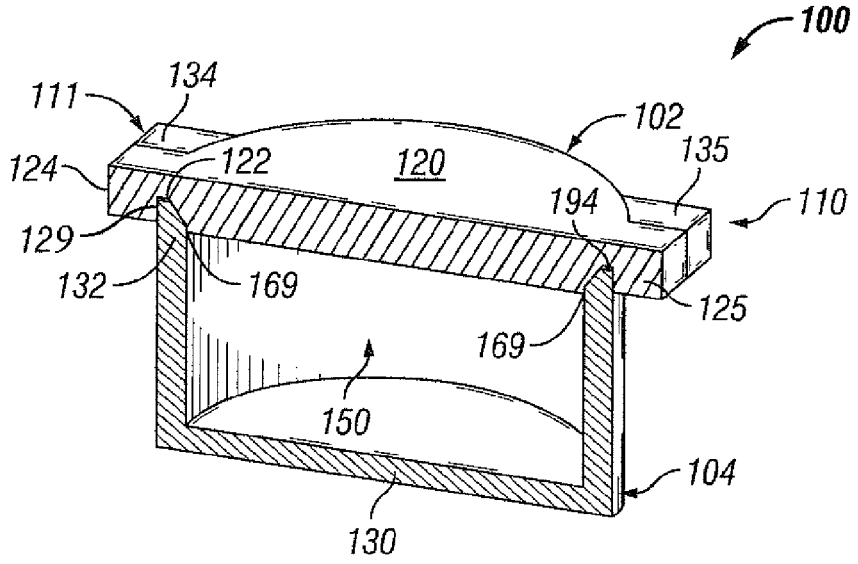
Figure 1C:
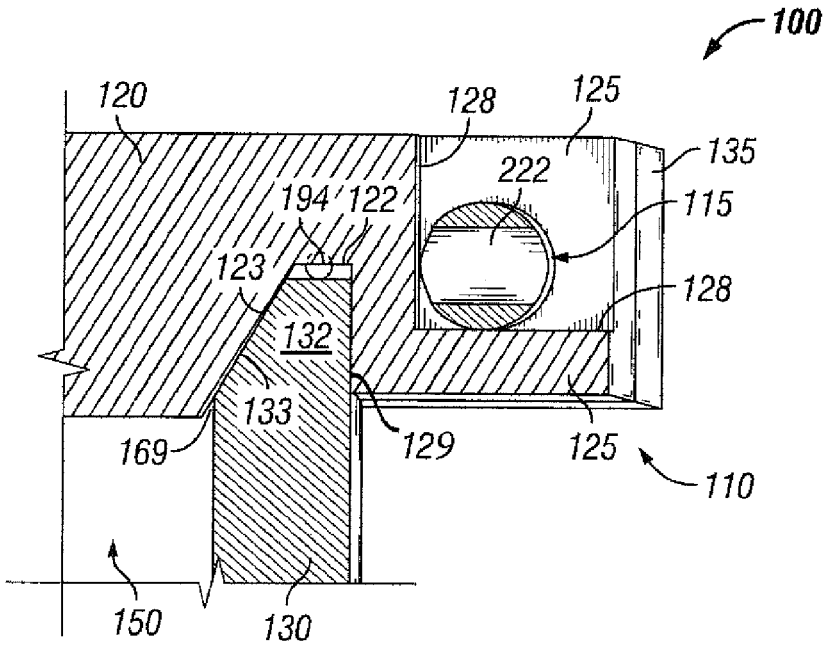
Figure 1D:
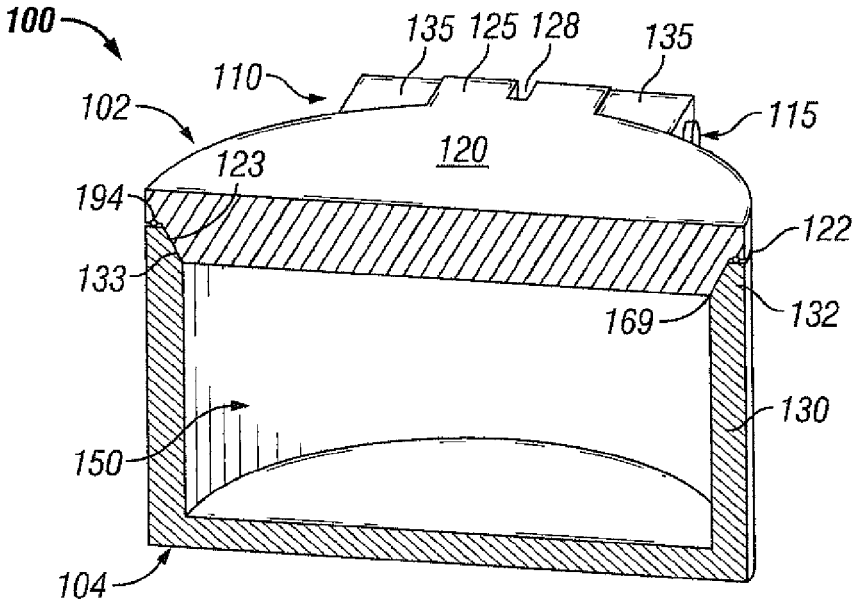

FIGS. 1A-1D show various views of an explosion-proof enclosure 100 with one or more example fastening feature 110, 111 in accordance with certain example embodiments. Specifically, FIG. 1A shows a perspective view of the enclosure 100. FIG. 1B shows a cross-sectional side perspective view of the enclosure 100. FIGS. 1C and 1D show a cross-sectional side views of the enclosure 100. In one or more embodiments, one or more of the features shown in FIGS. 1A-1D may be omitted, added, repeated, and/or substituted. Accordingly, embodiments of an explosion-proof enclosure with fastening features should not be considered limited to the specific arrangement of components shown in FIGS. 1A-1D.

Referring to FIGS. 1A-1D, fastening feature 110 can include a fastening device 115 and, in certain example embodiments, one or more engagement features (e.g., engagement feature 125, engagement feature 135), all described below. Similarly, fastening feature 111 can include a fastening device 114 and, in certain example embodiments, one or more engagement features (e.g., engagement feature 124, engagement feature 134). The fastening features and its various components can be the same and/or different from each other. When there are multiple fastening features, such fastening features can be disposed in one or more of a number of ways on the enclosure 100. For example, as shown in FIG. 1A, the fastening feature 110 (including any of its components, such as the engagement feature 125) can be disposed on a substantially opposite end of the enclosure 100 than the fastening feature 111 (including any of its components, such as the engagement feature 124).

The explosion-proof enclosure 100 can include an enclosure cover 102 and an enclosure body 104. The enclosure cover 102 can include a central portion 120, a flange 122 and at least one engagement feature (in this case, engagement feature 124 and engagement feature 125). The flange 122 of the enclosure cover 102 can be disposed on the bottom surface of the central portion 120 around the perimeter of the outer portion 121 of the enclosure cover 102. The flange 122 of the enclosure cover 102 can include at least one beveled edge, in this case, beveled edge 123.

The flange 122 can also include, in addition the beveled edge 123, other features and/or surfaces that allow part of the enclosure body 104 to be disposed within the enclosure cover 102. For example, as shown in FIGS. 1B and 1C, the flange 122 can also include a back wall 129 that forms, with the beveled edge 123, a cavity into which the top end of the enclosure body 104 can be disposed. The contour of the back wall 129 can be substantially the same as the outer surface of the flange 132.

In certain example embodiments, while the beveled edge 123 of the flange 122 and the beveled edge 133 of the flange 132 are disposed around the entire perimeter of the respective flanges, the back wall 129 of the flange 122 can only be disposed where engagement features (e.g., engagement feature 124, engagement feature 125) extend from the flange 122. In such a case, as shown in FIG. 1D, the back wall 129 of the flange 122 does not exist where the corresponding engagement feature is not located.

In certain example embodiments, the flange 122 can also include a channel (hidden from view) into which some or all of a sealing member 194 can be disposed. In addition, or in the alternative, the sealing member 194 can be disposed within a channel disposed in a top portion of the enclosure body 104. In any case, as the enclosure cover 102 mechanically couples to the enclosure body 104, the sealing member 194 is compressed, providing a seal against ingress while providing a flame path 169 that meets one or more applicable standards (e.g., flame path 169 no greater than 0.0015 inches). The sealing member 194 can be any type of sealing member (e.g., gasket, o-ring) made of a compressible material (e.g., rubber, silicon).

The engagement features (e.g., engagement feature 124, engagement feature 125) of the enclosure cover 102 can be disposed on an outer portion of the flange 122. For example, as shown in FIGS. 1A-1D, the engagement features can be a planar extension of the central portion 120 that are directed radially away from the flange 122. The engagement features can be a single member or multiple members. As shown in FIGS. 1A-1D, engagement feature 124 and engagement feature 125 each have one member. In certain example embodiments, each engagement feature can be considered part of the fastening feature 110.

Each engagement feature of the enclosure cover 102 can include one or more features that allow for interaction with a fastening device. An example of one such feature is a keyway (e.g., keyway 127, keyway 128) disposed within a portion of the engagement feature of the enclosure cover 102. The keyway can be shaped and positioned in the engagement feature to allow a user to access the keyhole 222 (described below) of a fastening device (e.g., fastening device 114, fastening device 115) when the fastening device is coupled to the engagement feature of the enclosure cover 102 and the engagement feature of the enclosure body 104. For example, the width of the keyway can be substantially the same as, or larger than, the width of the keyhole 222 disposed on the fastening device.

A keyway (e.g., keyway 127, keyway 128) can also be shaped to allow the keyhole 222 to rotate within a certain range (e.g., approximately 90°, approximately) 180° when the rotation of the fastening device (e.g., fastening device 114, fastening device 115) is controlled through a user's access through the keyway. In certain example embodiments, the keyhole 222 rotates within a range of no more than 360°. In this example, each keyway 127, 128 is shaped to allow the keyhole 222 of the fastening device 115 to rotate approximately 90°. This rotation of the fastening device 115 can be in one or more of a number of directions (e.g., upward, downward, inward, outward) that depend on one or more of a number of factors, including but not limited to the shape of the keyway 128, the shape of the fastening device 115, and the orientation of the fastening device 115 relative to the keyway 128. The keyway can be a single slot (as shown in FIGS. 1A-1C), multiple slots, or have some other configuration that allows access to and control of the keyhole 222 of the fastening device. The shape of the keyway can vary based on one or more of a number of factors, including but not limited to the range of rotation of the keyhole 222, the tool used to move the keyhole 222, and the size of the keyhole 222.

Another example of a feature that allows for interaction with a fastening device is one or more apertures (hidden from view) that traverse an entire portion (e.g., the entire width) of the engagement feature. In such a case, the apertures can have a shape that is sufficient to allow various portions of a fastening device (e.g., fastening device 114, fastening device 115) to pass therethrough and be disposed therein. In certain example embodiments, the aperture that traverses the engagement feature of the enclosure cover 102 is external to the enclosure 100, and so such aperture does not create a flame path in addition to flame path 169.

Each engagement feature of the enclosure cover 102 can be made from a single piece with the central portion 120 of the enclosure cover 102, as from a mold, or can be one or more separate pieces that are mechanically coupled to the central portion 120 using one or more of a number of coupling methods, including but not limited to welding, compression fittings, fastening devices, and mating threads. The enclosure cover 102 and its various features can be made of one or more of a number of suitable materials. Such materials can include, but are not limited to, stainless steel, aluminum, rubber, and plastic.

The shape and size of the central portion 120 of the enclosure cover 102 can be any of a number of shapes and sizes suitable for an explosion-proof enclosure using example fastening features 110. For example, as shown in FIGS. 1A-1D, the central portion 120 can be substantially circular when viewed from above. In such a case, the size (e.g., diameter, thickness) of the central portion 120 can vary. For example, the diameter of the central portion 120 can be 12 inches. As another example, the diameter of the central portion 120 can be 18 inches. The size of the central portion 120 can be larger or smaller than those given in the preceding examples. The central portion 120 can be planar (e.g., substantially flat) and/or have one or more three-dimensional features. For example, the central portion 120 can be dome-shaped and/or have one or more dome features, internally and/or externally. Examples of other shapes, when viewed from above, for the central portion 120 of the enclosure cover 102 can include, but are not limited to, oval, rectangular, figure eight, and triangular. Such shapes can have rounded or straight sides and/or corners.

In certain example embodiments, the enclosure body 104 includes a base 130, a flange 132, and one or more engagement features (e.g., engagement feature 134, engagement feature 135). The base can have a back and one or more walls adjacent to the back to form a cavity 150. Electrical and/or mechanical devices can be disposed within the cavity 150 when the enclosure cover 102 is mechanically coupled to the enclosure body 104.

The enclosure body 104 can also include a flange 132 disposed at the end of the one or more walls of the base 130. The flange 132 of the enclosure body 104 can include at least one beveled edge, in this case, beveled edge 133. The flange 132 can also include, in addition to the beveled edge 133, other features and/or surfaces that allow part of the enclosure body 104 to be disposed within the enclosure cover 102. For example, as shown in FIGS. 1A-1D, the flange 132 is shaped (e.g., flat top joining the beveled edge 133 and the outer surface of the wall of the base 130) complementary to the cavity formed as part of the flange 122 of the enclosure cover 102. In such a case, when the enclosure cover 102 is mechanically coupled to the enclosure body 104, the flange 122 of the enclosure cover 102 is mated to the flange 132 of the enclosure body 104.

When the flange 122 of the enclosure cover 102 is mated to the flange 132 of the enclosure body 104, a flame path 169 is formed. Because of the mated beveled edges 123 and 133, the enclosure cover 102 and the enclosure body 104 naturally align with each other. Further, the length of the flame path 169 is increased relative to the thickness of the wall of the base 130. Consequently, less material can be used to create the base 130 of the enclosure body 104 and/or central portion 120 of the enclosure cover 102 while maintaining a flame path 169 the allows the enclosure 100 to comply with various standards for explosion-proof enclosures.

In addition, the flame path 169 created by the beveled edges 123 and 133 reduces the gap created between the enclosure cover 102 and the enclosure body 104 when the enclosure cover 102 and the enclosure body 104 are subjected to pressure. For example, without beveled edges 123 and 133, the resulting gap for the flame path 169 is approximately 0.010 inches. By contrast, when the beveled edges 123 and 133 are set at 30°, the resulting gap for the flame path 169 is approximately 0.0087 inches. When the beveled edges 123 and 133 are set at 40°, the resulting gap for the flame path 169 is approximately 0.0077 inches. When the beveled edges 123 and 133 are set at 50°, the resulting gap for the flame path 169 is approximately 0.0064 inches. When the beveled edges 123 and 133 are set at 60°, the resulting gap for the flame path 169 is approximately 0.0050 inches. This reduction in the gap for the flame path 169 can reduce the fastening requirements (e.g., fastening force) of the fastening feature 110.

As discussed above with the flange 122 of the enclosure cover 102, the flange 132 of the enclosure body 104 can include a channel into which some or all of a sealing member 194 can be disposed. The optional channel in the flange 132 can be the same as (complementary to) or different than the channel in the flange 122. The sealing member 194 can be the same or a different sealing member from that described above. In addition, or in the alternative, the channel and the sealing member 194 can be disposed on the beveled edge 123 of the flange 122 and/or the beveled edge 133 of the flange 132.

The engagement features (e.g., engagement feature 134, engagement feature 135) of the enclosure body 104 can be disposed on an outer portion of the flange 132. For example, as shown in FIGS. 1A-1D, the engagement features can be extensions of the flange 132 that are directed radially away from the flange 132. The engagement features can be a single member or multiple members. As shown in FIGS. 1A-1C, engagement feature 134 and engagement feature 135 each have two members. In certain example embodiments, each engagement feature can be considered part of the fastening device 110.

Each engagement feature of the enclosure body 104 can include one or more features that allow for interaction with a fastening device (e.g., fastening device 114, fastening device 115). An example of one such feature is one or more keyways, as described above with respect to the engagement feature of the enclosure cover 102. While not shown in FIGS. 1A-1D, a keyway disposed in the engagement feature of the enclosure body 104 can be located on one or any other number of engagement features of the enclosure body 104. In addition, a keyway (e.g., keyway 127, keyway 128) can be disposed in both an engagement feature of the enclosure cover 102 and an engagement feature of the enclosure body 104.

Another example of a feature that allows for interaction with a fastening device is one or more apertures (hidden from view) that traverse an entire portion (e.g., the entire width) of the engagement feature. In such a case, the apertures can have a shape that is sufficient to allow various portions of a fastening device (e.g., fastening device 114, fastening device 115) to pass therethrough and be disposed therein. In certain example embodiments, the aperture that traverses the engagement feature of the enclosure body 104 is external to the enclosure 100, and so such aperture does not create a flame path in addition to flame path 169. As explained below, the size of the apertures that traverse the engagement features of the enclosure body 104 can be substantially the same as, but slightly different than, the size of the apertures that traverse the engagement features of the enclosure cover 102.

In addition, when the enclosure cover 102 is mechanically coupled to the enclosure body 104, the aperture that traverses the engagement feature 135 of the enclosure body 104 can be aligned with the aperture that traverses the engagement feature 125 of the enclosure cover 102. In such a case, a fastening device simultaneously can be disposed within the aperture that traverses the engagement feature of the enclosure body 104 and the aperture that traverses the engagement feature of the enclosure cover 102.

Thus, the engagement feature 135 of the enclosure body 104 and the engagement feature 125 of the enclosure cover 102 can interlock with each other. The arrangement of engagement features of the enclosure body 104 relative to engagement features of the enclosure cover 102 can vary. For example, as shown in FIGS. 1A-1D, the two engagement features 135 of the enclosure body 104 can be positioned on either side of the engagement feature 125 of the enclosure cover 102. As another example, two engagement features 125 of the enclosure cover 102 can be positioned on either side of one engagement feature 135 of the enclosure body 104. As yet another example, five engagement features 135 of the enclosure body 104 can be symmetrically interlaced with four engagement features 125 of the enclosure cover 102. In any case, the interlocking engagement features can have only one keyway or multiple keyways 128.

Each engagement feature of the enclosure body 104 can be made from a single piece with the base 130 of the enclosure body 104, as from a mold, or can be one or more separate pieces that are mechanically coupled to the base 130 (or, more specifically, the flange 132 of the base 130) using one or more of a number of coupling methods, including but not limited to welding, compression fittings, fastening devices, and mating threads. The enclosure body 104 and its various features can be made of one or more of a number of suitable materials. Such materials can include, but are not limited to, stainless steel, aluminum, rubber, and plastic.

The shape and size of the base 130 of the enclosure body 104 can be any of a number of shapes and sizes suitable for an explosion-proof enclosure using example fastening features 110. For example, as shown in FIGS. 1A-1D, the base 130 can be substantially circular when viewed from above. In such a case, the size (e.g., diameter, thickness) of the base 130 can vary. For example, the diameter of the base 130 can be 12 inches. As another example, the diameter of the central portion can be 18 inches. The base 130 also can be square, rectangular, oval, hexagonal, or any other shape when viewed from above, provided that the shape of the flange 132, when viewed from above, is substantially the same as the shape of the flange 122 of the enclosure cover 102. Thus, the shape of the base 130, when viewed from above, can be the same shape or a different shape than the shape of the central portion 120 when viewed from above. In addition, or in the alternative, the size of the shape of the base 130 and/or the size of the shape of the central portion 120, when viewed from above, can vary along their height. In such a case, the size of the shape of the base 130 and the size of the shape of the central portion 120, when viewed from above, can be substantially the same for a given height when the enclosure cover 102 is coupled to the enclosure body 104.

In certain example embodiments, when there are multiple fastening features 110, 111 for an enclosure 100, at least one of the fastening features 110, 111 can act merely as a hinge rather than a fastening feature. For example, in FIG. 1A, fastening feature 111 can be a hinge, hingedly coupling the enclosure cover 102 and the enclosure body 104, while fastening feature 110 can create and maintain the flame path 169 between the enclosure cover 102 and the enclosure body 104. In such a case, the fastening device 114 of the hinge can have, for example, a uniform width and height along its length. Alternatively, both the fastening device 114 and the fastening device 115 can have one or more oblong sections (described below with respect to FIGS. 2A-2D), which allows both fastening feature 111 and fastening feature 110 to create and maintain the flame path 169 between the enclosure cover 102 and the enclosure body 104.

In certain example embodiments, when there are multiple fastening features (e.g., fastening feature 110, fastening feature 111), there can be a mechanical linkage between two or more of the fastening features. In such a case, moving (e.g., rotating) one of the fastening features can move a linked fastening feature a corresponding amount. For example, for fastening feature 110 and fastening feature 111, if fastening feature 110 is rotated by 90°, then the linkage between fastening feature 110 and fastening feature 111 would cause fastening feature 111 to rotate (in the same or a different direction) by 90°.

Figure 2A:
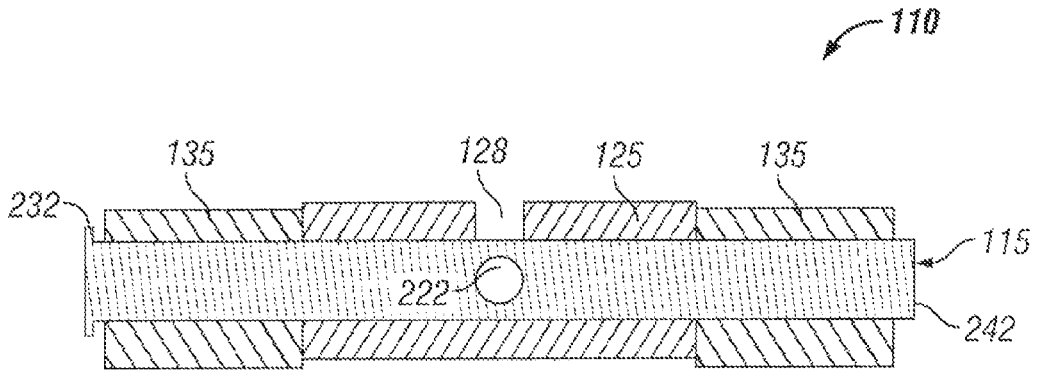
FIGS. 2A-2D perspective views of various components of the example fastening feature of FIG. 1 in accordance with certain example embodiments.
Figure 2B:
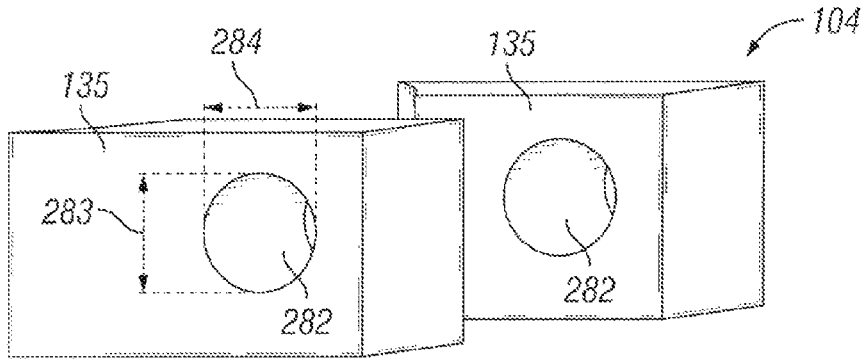
Figure 2C:
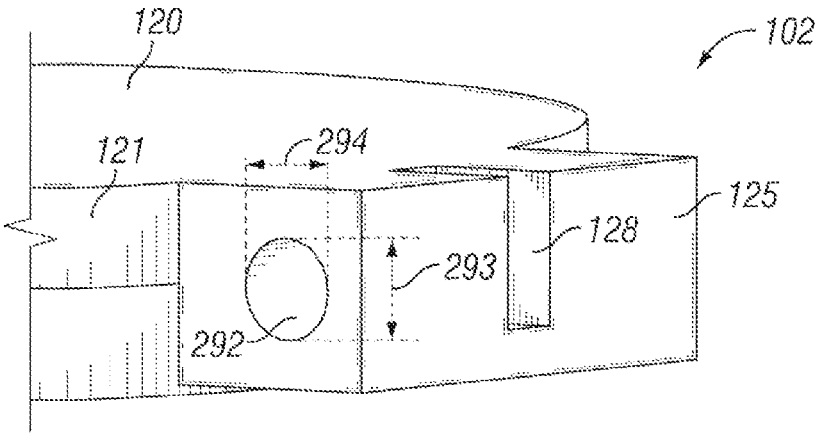
Figure 2D:
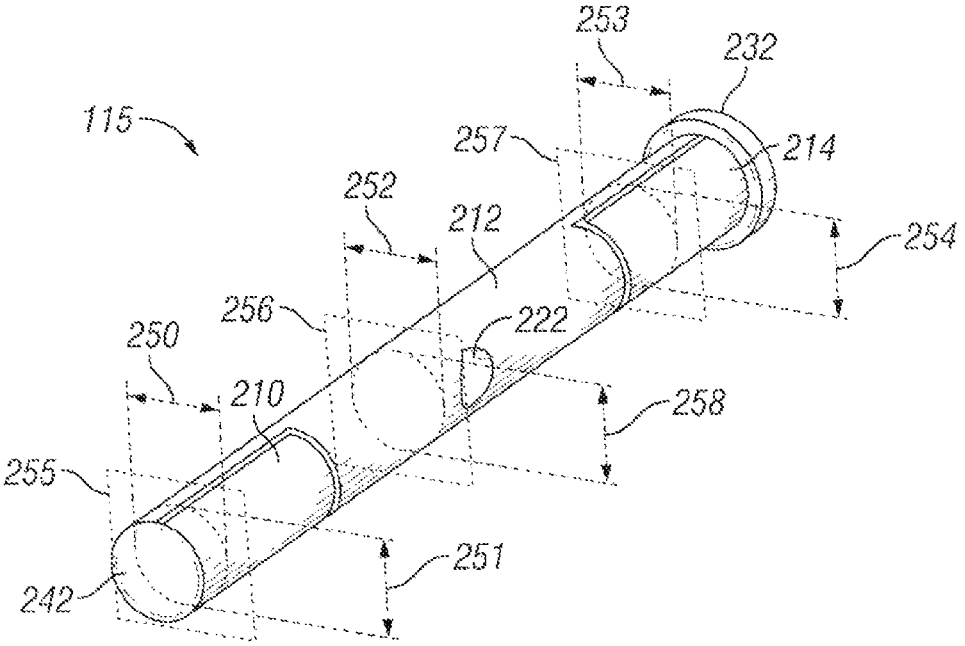

FIGS. 2A-2D show various views of the example fastening feature 110 from FIGS. 1A-1D in accordance with certain example embodiments. Specifically, FIG. 2A shows a cross-sectional front view of the components of the fastening feature 110. FIG. 2B shows a perspective view of the engagement features 135 of the enclosure body 104. FIG. 2C shows a perspective view of the engagement feature 125 of the enclosure cover 102. FIG. 2D shows a perspective view of the fastening device 115. In one or more embodiments, one or more of the features shown in FIGS. 2A-2D may be omitted, added, repeated, and/or substituted. Accordingly, embodiments of a fastening feature should not be considered limited to the specific arrangement of components shown in FIGS. 2A-2D.

Referring to FIGS. 1A-2D, the fastening device 115 of the fastening feature 110 is shown in FIGS. 2A-2D in a disengaged position. In a disengaged position, the fastening device 115 (and, thus, the fastening feature 110) fails to maintain the flame path 169 between the flange 122 and the flange 132 in such a way that prevents the flame path 169 from complying with one or more standards. The fastening device 115 can be moved into an engaged position by moving (in this case, rotating) the fastening device 115. In the engaged position, the fastening device 115 (and, thus, the fastening feature 110) creates and maintains a flame path 169 between the flange 122 and the flange 132 in such a way that allows the flame path 169 to comply with one or more standards.

In this example, there are two engagement features 135 for the enclosure body 104. Thus, each engagement feature 135 can have an aperture 282 that traverses therethrough, as shown in FIG. 2B. When viewed cross-sectionally, the width 284 and the height 283 of each aperture 282 can be the same or different from each other. In this case, the width 284 of each aperture 282 is substantially the same as the height 283 of the aperture 282. For example, the width 284 and height 283 of the apertures 282 can each be approximately 1.045 inches.

In certain example embodiments, the width 284 and the height 283 of each aperture 282 through an engagement feature 135 of the enclosure body 104 is substantially the same along the length of the aperture 282, as is the case in this example. Conversely, the width 284 and the height 283 of each aperture 282 through an engagement feature 135 of the enclosure body 104 can vary along the length of the aperture 282.

In this example, there is one engagement feature 125 for the enclosure cover 102, but the keyway 128 disposed approximately halfway along the length of the engagement feature 125 creates two apertures 292 in the engagement feature 125. Thus, the engagement feature 125 can have two apertures 292 that traverse therethrough, as shown in FIG. 2C. When viewed cross-sectionally, the width 294 and the height 293 of each aperture 292 can be the same or different from each other. In this case, the width 294 of each aperture 292 is larger than the height 293 of the aperture 292. For example, the width 294 of the aperture 292 can be approximately 1.045 inches, while the height 293 of the aperture 292 can each be approximately 1.000 inches.

The width 294 and the height 293 of each aperture 292 through the engagement feature 125 of the enclosure cover 102 can be substantially the same along the length of the aperture 292, as is the case in this example. Conversely, the width 294 and the height 293 of each aperture 292 through the engagement feature 125 of the enclosure cover 102 can vary along the length of the aperture 292.

The fastening device 115 can have one or more of a number of shapes, sizes, and features that allow the fastening device 115 to be disposed within the apertures 282 of the engagement features 135 and the apertures 292 of the engagement feature 125 and manipulate the enclosure body 104 and the enclosure cover 102 to create and maintain the desired flame path 169. As can be seen in FIG. 2D, the fastening device 115 is substantially cylindrical in shape, but some of the dimensions can vary (e.g., have an oblong shape) along its length.

In the cross-sectional plane 255, positioned close to the distal end 242 of the fastening device 115, the width 250 of the fastening device 115 is slightly larger than the height 251 of the fastening device 115. For example, the width 250 of the fastening device 115 can be approximately 1.045 inches, while the height 251 of the fastening device 115 can be approximately 1.000 inches. In other words, the width 250 of the fastening device 115 can be approximately the same as the width 284 of the aperture 282 of the engagement feature 135, and the height 251 of the fastening device 115 can be less than the height 283 of the aperture 282 of the engagement feature 135. Put another way, the portion 210 of the fastening device 115 can have an oblong (width is different than the height) shape. The portion 210 of the fastening device 115 that corresponds to cross-sectional plane 255 can be positioned within the aperture 282 of one of the engagement features 135 of the enclosure body 104.

In the cross-sectional plane 257, positioned close to the proximal end 232 of the fastening device 115, the width 253 of the fastening device 115 is slightly larger than the height 254 of the fastening device 115. For example, the width 253 of the fastening device 115 can be approximately 1.045 inches, while the height 254 of the fastening device 115 can be approximately 1.000 inches. In other words, the width 253 of the fastening device 115 can be approximately the same as the width 284 of the aperture 282 of the engagement feature 135, and the height 254 of the fastening device 115 can be less than the height 283 of the aperture 282 of the engagement feature 135.

In such a case, the portion 214 of the fastening device 115 can have an oblong shape. The portion 214 of the fastening device 115 that corresponds to cross-sectional plane 257 can be positioned within the aperture 282 of the other of the engagement features 135 of the enclosure body 104. If the size of the apertures 282 in the engagement features 135 of the enclosure body 104 are different from each other, than the width 253 and the height 254 of the cross-sectional plane 257 in portion 214 of the fastening device 115 can be different from the width 250 and the height 251 of the cross-sectional plane 255 in portion 210 of the fastening device 115.

In the cross-sectional plane 256, positioned toward the middle 212 of the fastening device 115, the width 252 of the fastening device 115 is substantially the same as the height 258 of the fastening device 115. For example, the width 252 of the fastening device 115 can be approximately 1.000 inches, and the height 258 of the fastening device 115 also can be approximately 1.000 inches. In other words, the width 252 of the fastening device 115 can be less than the width 294 of the aperture 292 of the engagement feature 125, and the height 258 of the fastening device 115 can be substantially the same as the height 293 of the aperture 292 of the engagement feature 125. The portion 212 of the fastening device 115 that corresponds to cross-sectional plane 256 can be positioned within the aperture 292 of the engagement feature 125 of the enclosure cover 102.

In certain example embodiments, the proximal end of the fastening device 115 includes, or is, a cap 232. The cap 232 of the fastening device 115 can have a width and/or a height that exceeds any width and height of the remainder of the fastening device 115. In addition, or in the alternative, the cap 232 can have a width and/or a height that exceeds the width and height of the aperture 282 of the engagement feature 135. Consequently, the cap 232 cannot enter into the aperture 282 of the engagement feature 115. Thus, the cap 232 can control, to some extent, the lateral position of the fastening device 115 relative to the aperture 282 of the engagement feature 135 and the aperture 292 of the engagement feature 125.

In certain example embodiments, the keyhole 222 of the fastening device 115 can be disposed at one or more points along the length of the fastening device 115. For example, as shown in FIG. 2D, the keyhole 222 can be positioned between the portion 210 and the portion 214, approximately halfway along the length of the fastening device 115 in portion 212. The location of the keyhole 222 can correspond to an oblong portion or a non-oblong (symmetrical) portion of the fastening device 115.

If the fastening device 115 includes more than one keyhole 222, then the engagement feature 125 and/or the engagement feature 135 can include more than one keyway 128. When the fastening device 115 is positioned laterally within the aperture 282 of the engagement feature 135 and within the aperture 292 of the engagement feature 125, then the keyhole 222 of the fastening device 115 can be aligned with a keyway (e.g., keyway 127, keyway 128) disposed in the engagement feature 125 or the engagement feature 135. For example, when the fastening device 115 is inserted into the aperture 282 and the aperture 292 until the cap 232 abuts against the outer-most engagement feature (in this example, engagement feature 135), then the keyhole 222 of the fastening device 115 can be aligned within a keyway 128. As a result, the keyhole 222 can be accessible in the keyway when the fastening device 115 is mechanically coupled to the engagement feature 125 and the engagement feature 135.

By rotating the keyhole 222 within a keyway (e.g., keyway 127, keyway 128), the fastening device 115 can be moved between an engaged position and a disengaged position relative to the engagement feature 125 and the engagement feature 135. The keyhole 222 can be rotated with or without the use of a tool. For example, a tool is used to engage the keyhole 222 and move (in this case, rotate) the fastening device 115. In such a case, the tool fits in the keyhole 222 to provide the leverage to needed to move the fastening device 115. Each fastening device (e.g., fastening device 114, fastening device 115) can be made of one or more of a number of suitable materials. Examples of such materials can include, but are not limited to, a high strength alloy (e.g., stainless steel), titanium, and ceramic.

Each keyhole 222 of the fastening device 115 can have one or more of a number of shapes and features, and can be located at any point along the length of the fastening device 115. In addition to the example of the keyway 222 shown and described above in FIG. 2D, another example of a keyway 222 can be a slot that is disposed on the outer surface of the cap 232. In such a case, a tool in the form of a flat-head screw driver can be used to move (e.g., rotate, slide) the fastening device 115 using the keyway 222. In order to limit the rotation of the fastening device 115, as an example, the cap 232 can be shaped with a combination of curved surfaces (as shown in FIG. 2D) and flat surfaces. When the outer surface of the engagement feature 135 includes one or more protruding and/or recessed features (not shown), then the rotational movement of the fastening device 115 can be limited.

As another example of a keyway 222, a hexagonal aperture (not shown) can be disposed on the outer surface 242 of the distal end of the fastening device 115. In such a case, a hex-head wrench can be used as a tool to move (e.g., rotate) the fastening device 115 using the keyway 222. In order to limit the rotation of the fastening device 115, as an example, the cap 232 can be shaped with a combination curved surfaces (as shown in FIG. 2D) and flat surfaces. As with the above example, when the outer surface of the engagement feature 135 includes one or more protruding and/or recessed features (not shown), then the rotational movement of the fastening device 115 can be controlled. As illustrated by these examples, the keyway 128 can be an optional feature of the enclosure 100. In certain example embodiments, the fastening device 115 must move (e.g., rotate, slide) a minimum amount in order for the fastening device 115 to reach the engaged position and/or the disengaged position.

Figure 3A:
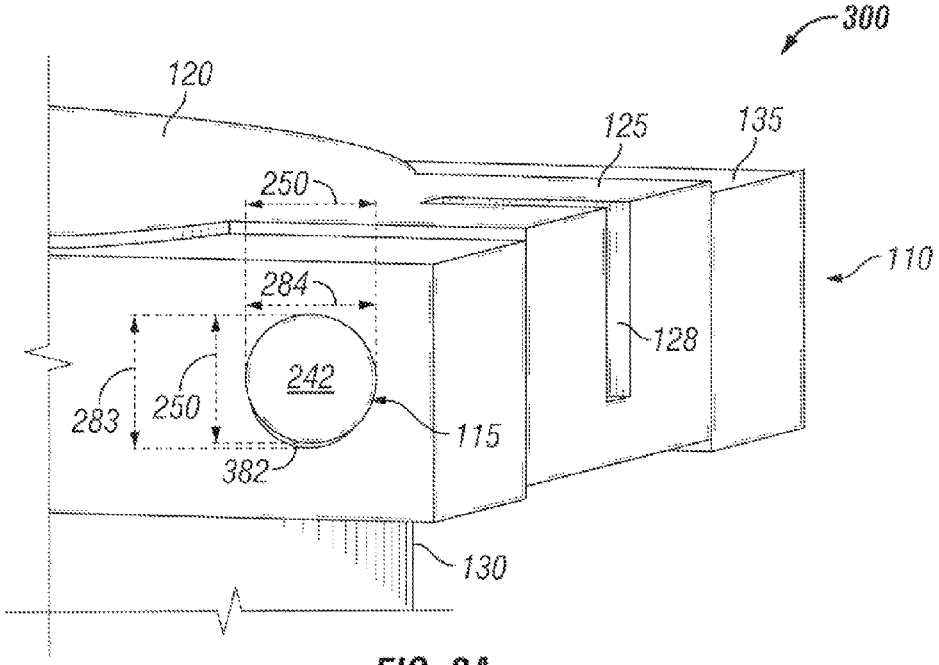
FIGS. 3A and 3B show perspective views detailing various components of the example fastening feature of FIGS. 1A-2D in accordance with certain example embodiments.
Figure 3B:
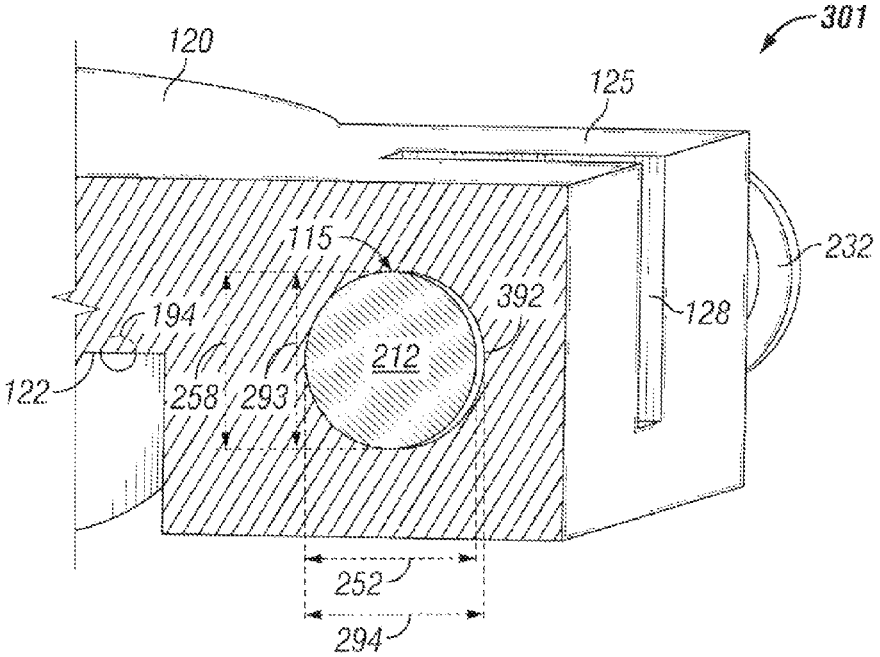

FIGS. 3A and 3B show perspective views detailing various components of the example fastening feature 110 of FIGS. 1A-2D in accordance with certain example embodiments. Specifically, FIG. 3A shows a perspective view that details the interaction of the fastening device 115 and the engagement feature 135. FIG. 3B shows a cross-sectional perspective view that details the interaction of the fastening device 115 and the engagement feature 125. In one or more embodiments, one or more of the features shown in FIGS. 3A and 3B may be omitted, added, repeated, and/or substituted. Accordingly, embodiments of a fastening feature should not be considered limited to the specific arrangement of components shown in FIGS. 3A and 3B.

The fastening device 115 (and, thus, the fastening feature 110) of FIGS. 3A and 3B is shown in the disengaged position. Referring to FIGS. 1A-3B, the fastening device 115 is positioned within the cavities 282 of the engagement feature 135 and the cavities 292 of the engagement feature 125. The distal end 242 of the fastening device 115 is visible. Because the portion 210 and the portion 214 of the fastening device 115 are oblong (the widths 250 of the portions 210, 214 of the fastening device 115 are different than the height 251 of the portions 210, 214 of the fastening device 115), and because the apertures 282 in the engagement feature 135 are circular (the widths 284 of the apertures 282 are substantially the same as the heights 283 of the apertures 282), there is a gap 382 within the apertures 282 between the engagement feature 135 and the portions 210 and 214.

In this case, the width 250 of the portions 210, 214 of the fastening device 115 is substantially the same as the width 284 of the aperture 282, and the height 251 of the portions 210, 214 of the fastening device 115 is less than the height 283 of the aperture 282. Therefore, the gap 382 can appear at the top (as shown in FIG. 3A) and/or the bottom of the fastening device 115. If the fastening device 115 is rotated by 90° (i.e., moves to the engaged position), then the gap 382 appears on one or both sides of the fastening device 115.

With respect to the interaction between the fastening device 115 and the aperture 292 of the engagement feature 125, as shown in FIG. 3B, a gap 392 can also appear within the apertures 292 between the fastening device 115 and the engagement feature 125. In this case, the portion 212 of the fastening device 115 is substantially circular. In other words, the width 252 and the height 258 of the portion 212 of the fastening device 115 are substantially the same. The apertures 292 of the engagement feature 125, however, are oblong. In this case, the width 294 of the apertures 292 is greater than the height 293 of the apertures 292.

Consequently, when the fastening device 115 is in the disengaged position, as shown in FIG. 3B, the gap 392 appears on one or both sides of the fastening device 115. In other words, the width 294 of the apertures 292 is greater than the width 252 of the portion 212 of the fastening device 115, while the height 293 of the apertures 292 is substantially the same as the height 258 of the portion 212 of the fastening device 115. If the fastening device 115 is rotated by 90° (i.e., moves to the engaged position), then the gap 392 continues to appear on one or both sides of the fastening device 115.

Figure 4A:
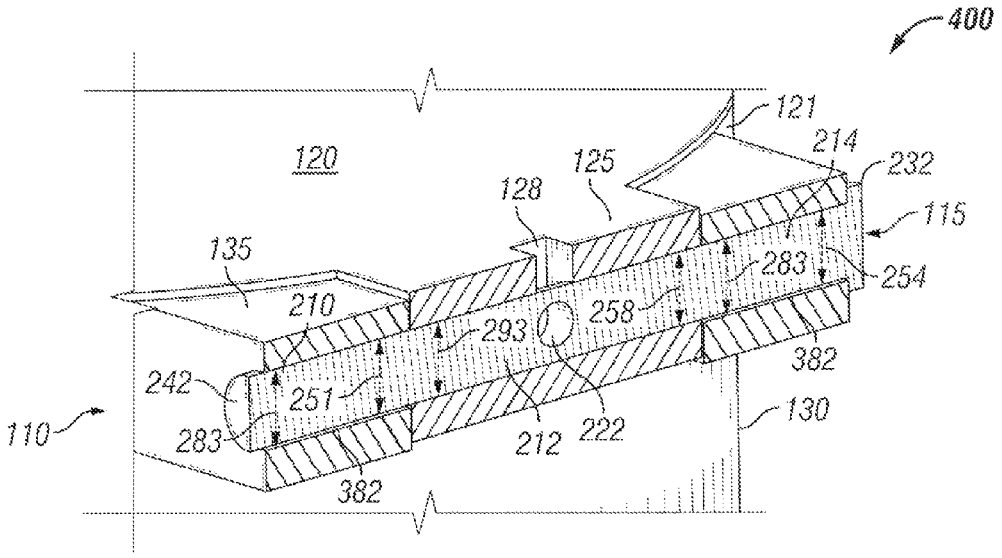
FIGS. 4A and 4B show various views of the example fastening feature of FIGS. 1A-3B in an unfastened position in accordance with certain example embodiments.
Figure 4B:
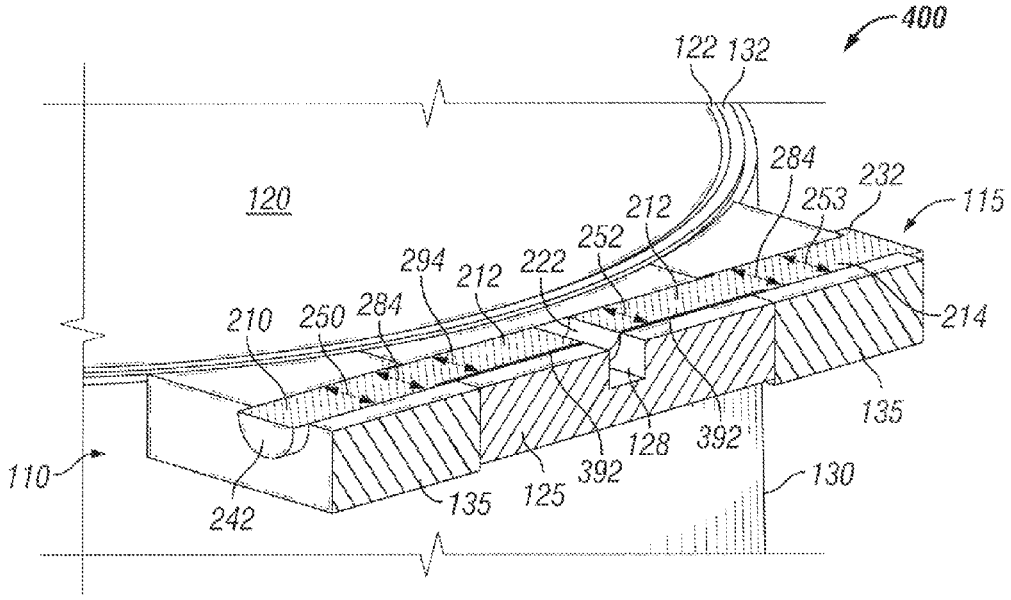
Figure 5A:
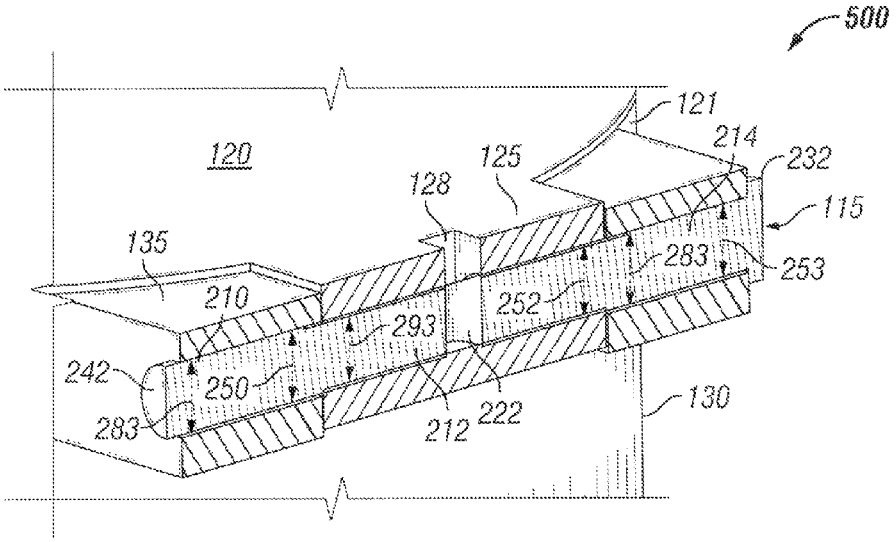
FIGS. 5A and 5B show various views of the example fastening feature of FIGS. 1A-3B in a fastened position in accordance with certain example embodiments.
Figure 5B:
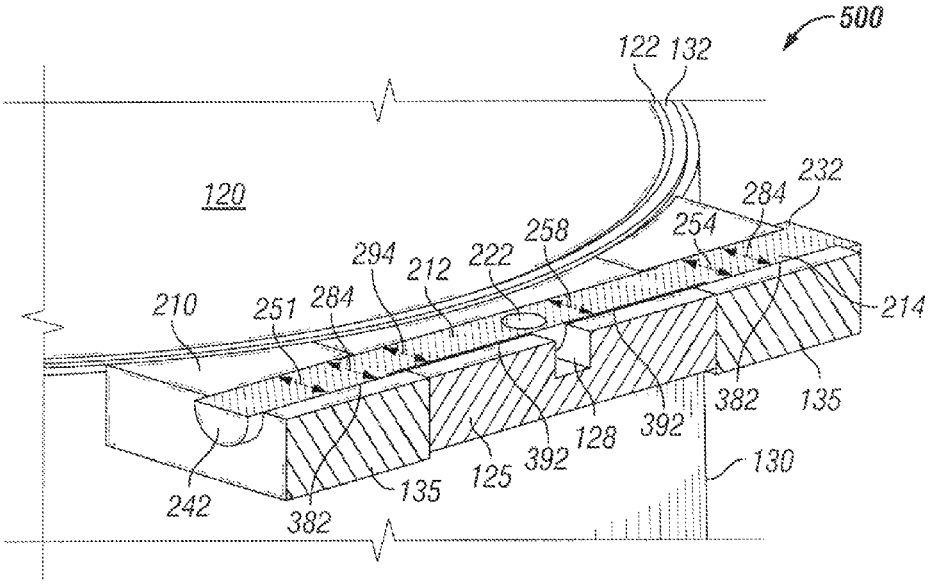

FIGS. 4A-5B show how movement of the fastening device 115 (and, thus, the fastening feature 110) from the disengaged position (shown in FIGS. 4A and 4B) to the engaged position (shown in FIGS. 5A and 5B) creates and maintains the flame path 169 between the enclosure cover 102 and the enclosure body 104. Specifically, FIGS. 4A and 4B show a vertical cross section and a horizontal cross section, respectively, of an enclosure 400 with the fastening feature 110 in the disengaged position. FIGS. 5A and 5B show a vertical cross section and a horizontal cross section, respectively, of the enclosure 500 with the fastening feature 110 in the engaged position. In one or more embodiments, one or more of the features shown in FIGS. 4A-5B may be omitted, added, repeated, and/or substituted. Accordingly, embodiments of enclosures with example fastening features should not be considered limited to the specific arrangement of components shown in FIGS. 4A-5B.

Referring to FIGS. 1A-5B, when the fastening device 115 is in the disengaged position, as shown in FIGS. 4A and 4B, the fastening device 115 is positioned within the cavities 282 of the engagement feature 135 and the cavities 292 of the engagement feature 125. The distal end 242 of the fastening device 115 is visible. As explained above, the portion 210 and the portion 214 of the fastening device 115 is oblong (the widths 250 of the portions 210, 214 of the fastening device 115 are different than the heights 251 of the portions 210, 214 of the fastening device 115). Since the apertures 282 in the engagement feature 135 are circular (the widths 284 of the apertures 282 are substantially the same as the heights 283 of the apertures 282), there is a gap 382 within the apertures 282 between the engagement feature 135 and the portions 210 and 214.

With the fastening device 115 in the disengaged position, the gaps 382 (shown in FIG. 4A) within the apertures 282 between the engagement feature 135 and the portions 210 and 214 of the fastening device 115 are located below (as in this case) and/or above the fastening device 115. The gaps 382 exist at this location because the height 251 of portion 210 and the height 254 of portion 240 are less than the heights 283 of apertures 282 (as shown in FIG. 4A), while the width 250 of portion 210 and the width 253 of the portion 214 are substantially the same as the widths 284 of the apertures 282 (as shown in FIG. 4B).

Similarly, the gaps 392 (shown in FIG. 4B) within the apertures 292 between the engagement feature 125 and the portion 212 of the fastening device 115 are located to one (as in this case) or both sides of the fastening device 115. The gaps 392 exist at this location because the width 252 of portion 212 is less than the width 294 of apertures 292, while the height 258 of portion 212 is substantially the same as the height 293 of the apertures 292.

When the fastening device 115 is moved (e.g., rotated, slides), the fastening feature 115 appears as shown in FIGS. 5A and 5B. In this example, the fastening device 115 can be moved to the engaged position by inserting a tool (not shown) into the keyhole 222, accessible using the keyway 128, and rotating upward by approximately 90°. When this occurs, the various widths and heights of portions of the fastening device 115 change place to become heights and widths, respectively. For example, the width 250 and height 251 of portion 210 when the fastening device 115 is in the disengaged position becomes the width 251 and height 250 of portion 210 when the fastening device 115 is in the engaged position. The designation of the widths and heights of the apertures for the engagement feature 125 and the engagement feature 135 do not change, regardless of the position (engaged, disengaged) of the fastening device 115.

Therefore, with the fastening device 115 in the engaged position, the gaps 382 (shown in FIG. 5B) within the apertures 282 between the engagement feature 135 and the portions 210 and 214 of the fastening device 115 are located on one side (as in this case) or both sides of the fastening device 115. The gaps 382 exist at this location because the width 251 of portion 210 and the width 254 of portion 240 are less than the widths 284 of apertures 282 (as shown in FIG. 5B), while the height 250 of portion 210 and the height 253 of the portion 214 are substantially the same as the heights 284 of the apertures 282 (as shown in FIG. 5A).

Similarly, the gaps 392 (shown in FIG. 5B) within the apertures 292 between the engagement feature 125 and the portion 212 of the fastening device 115 continue to be located on one or both sides of the fastening device 115. The gaps 392 exist at this location because the height 252 of portion 212 is substantially the same as the height 293 of apertures 292 (as shown in FIG. 5A), while the width 258 of portion 212 is less than the width 294 of the apertures 292 (as shown in FIG. 5B).

When the fastening device 115 (and, thus, the fastening feature 110) is moved into the engaged position, the fastening device 115, with its oblong features, combines with apertures 282 and 292 (along with its oblong features, if any) push the engagement feature 135 (and, thus, the flange 132) of the enclosure body 104 upward, while also pushing the engagement feature 125 (and, thus, the flange 122) of the enclosure cover 102 downward. Thus, the fastening device 115, when in the engaged position, push the flange 122 and the flange 132 toward each other, creating and maintaining the flame path 169 in compliance with regulations and/or standards that apply to enclosures in explosion-proof and/or other hazardous environments. In addition, the fastening device 115 (and, thus, the fastening feature 110) remains locked in the engaged position (held in place by friction) until a user, with the aid of a tool that is designed to work with the keyhole 222, moves (e.g., rotates) the fastening device 115 out of the engaged position into the disengaged position.

In certain example embodiments, the fastening device can have one or more features (e.g., ramps) that can cause the cover and body to converge (form the flame path between the cover flange and the body flange) by merely inserting the pin, without rotation or in addition to rotation. Such features of the fastening device can also be enabled and/or retracted by performing an action (e.g., pushing a button on the fastening device, moving a lever, moving the fastening device a certain distance within the apertures 282).

Figure 6A:
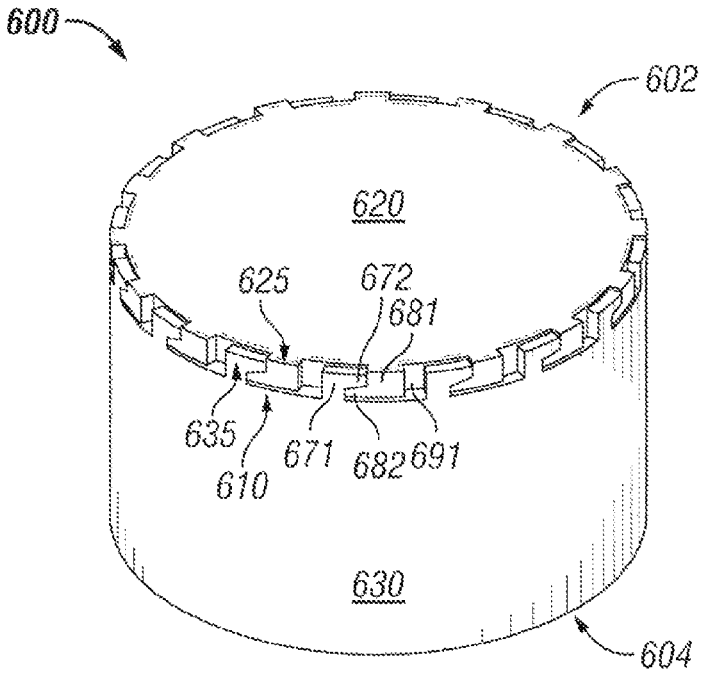
FIGS. 6A and 6B show various views of an explosion-proof enclosure with another example fastening feature in accordance with certain example embodiments.
Figure 6B:
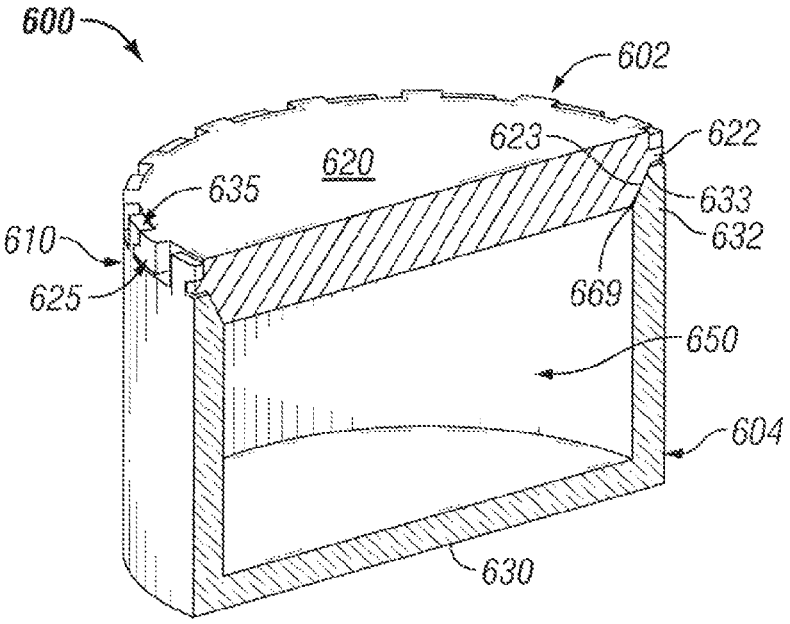

FIGS. 6A and 6B show various views of an explosion-proof enclosure 600 with another example fastening feature 610 in accordance with certain example embodiments. Specifically, FIG. 6A shows a perspective view of the explosion-proof enclosure 600, and FIG. 6B shows a cross-sectional perspective view of the explosion-proof enclosure 600. In one or more embodiments, one or more of the features shown in FIGS. 6A and 6B may be omitted, added, repeated, and/or substituted. Accordingly, embodiments of enclosures with example fastening features should not be considered limited to the specific arrangement of components shown in FIGS. 6A and 6B.

The enclosure 600 of FIGS. 6A and 6B is similar to the enclosure 100 of FIGS. 1A-1D in that the flange 622 of the enclosure cover 602 can include at least one beveled edge, in this case, beveled edge 623. Similarly, the flange 632 of the enclosure body 604 can include at least one beveled edge, in this case, beveled edge 633. When the enclosure cover 602 is coupled to the enclosure body 604, the surface of the beveled edge 623 is mated against the beveled edge 633. However, the enclosure 600 has the fastening features 610, as described below, instead of the fastening features 110 of FIGS. 1A-1D.

Referring to FIGS. 1A-6B, in this example, the enclosure 600 includes a number of fastening features 610 disposed around the perimeter of the enclosure 600. Each fastening feature 610 includes a cover portion 625 and a body portion 635. Each cover portion 625 can extend from the outer edge (the flange 622) of the enclosure cover 602. In certain example embodiments, each cover portion 625 can extend from the outer perimeter of the central portion 620 of the enclosure cover 602. The cover portion 625 of the fastening feature 610 can extend from the central portion 620 of the enclosure cover 602 so that the cover portion 625 is planar with the central portion 620.

Alternatively, the cover portion 625 of the fastening feature 610 can extend from the central portion 620 of the enclosure cover 602 at an angle (e.g., 90°). As another alternative, as shown in FIGS. 6A and 6B, the cover portion 625 of each fastening feature 610 can be an extension that protrudes from the outer perimeter of the central portion 620 of the enclosure cover 602. In such a case, and the cover portion 625 can be oriented at an angle (e.g., 90°) relative to the central portion 620 of the enclosure cover 602.

In certain example embodiments, the cover portion 625 of each fastening feature 610 includes a base 681 and an extension 682 that extends from one side of the distal (e.g., bottom) end of the base 681. The extension 682 can extend from a side of the base 681 at any of a number of angles (e.g., 90°). The extension 682 can have a linear or planar outer surface, as shown in FIGS. 6A and 6B. Alternatively, the extension 682 can have one or more of a number of other shapes, with various contours for the outer surface of the extension 682. For example, the extension 682 can be a radial or cam surface. The size, shape, and/or contour of one extension 682 can be the same as or different than the other extensions 682. When there are multiple cover portions 625 disposed on the central portion 620 of the enclosure cover 602, each extension 682 extends from the same side (in the same direction) from each corresponding base 681.

Each body portion 635 can extend from the outer edge (the flange 632) of the enclosure body 604. In certain example embodiments, each body portion 635 can extend from the outer perimeter of the flange 632 of the enclosure cover 602. As shown in FIGS. 6A and 6B, the body portion 635 of the fastening feature 610 can extend from the flange 632 of the enclosure body 604 so that the body portion 635 is planar with the side wall of the enclosure body 604.

Alternatively, the body portion 635 of the fastening feature 610 can extend away from the side wall (e.g., flange 632) of the enclosure body 604 at an angle (e.g.,) 90°. As another alternative, the body portion 635 of each fastening feature 610 can be an extension that protrudes from the side wall of the enclosure body 604. In such a case, and the body portion 635 can be oriented at an angle (e.g., 90°) relative to the side wall of the enclosure body 604.

In certain example embodiments, the body portion 635 of each fastening feature 610 includes a base 671 and an extension 672 that extends from one side of the distal (e.g., top) end of the base 671. The extension 672 can extend from a side of the base 671 at any of a number of angles (e.g., 90°). The extension 672 can have a linear or planar outer surface, as shown in FIGS. 6A and 6B. Alternatively, the extension 672 can have one or more of a number of other shapes, with various contours for the outer surface of the extension 672. For example, the extension 672 can be a radial or cam surface. In any case, the extension 672 is configured to create an interference with the extension 682 of the cover portion 625, creating a downward force on the enclosure 602 cover and/or an upward force on the enclosure body 604. In other words, the interference created between the extension 672 and the extension 682 is material to cause narrowing of the flame path 669. The size, shape, and/or contour of one extension 672 can be the same as or different than the other extensions 672. When there are multiple body portions 635 disposed on the enclosure body 604, each extension 672 extends from the same side (in the same direction) from each corresponding base 671.

In certain example embodiments, the positioning and orientation of the body portion 635 of the fastening feature 610 is complementary to the cover portion 625. For example, if the cover portion 625 of each fastening feature 610 is an extension that protrudes from the outer perimeter of the central portion 620 of the enclosure cover 602, where the extension 682 protrudes from the left side of the base 681 at an angle of 100°, then the body portion 635 of the fastening feature 610 can extend from the flange 632 of the enclosure body 604 so that the body portion 635 is planar with the side wall of the enclosure body 604, where the extension 672 protrudes from the right side of the base 671 at an angle of 100°. In this way, the body portion 635 can interlock with the cover portion 625 by rotating the enclosure cover 602 in a clockwise direction and/or the enclosure body 604 in a counter-clockwise direction.

The width of the extension 682 and the base 681 (in terms of horizontal displacement if the extension 682 extends from the base 681 at an angle other than 90° and/or if the base 681 extends or protrudes from the central portion 620 at an angle other than 90°) can be less than the space between adjacent body portions 635, as measured from the horizontal displacement of the distal end of extension 672 of one to body portion 635 to the horizontal displacement of the edge of the base 671 of the adjacent body portion 635. Similarly, the width of the extension 672 and the base 671 (in terms of horizontal displacement if the extension 672 extends from the base 671 at an angle other than 90° and/or if the base 671 extends or protrudes from the side wall of the enclosure body 604 at an angle other than 90°) can be less than the space between adjacent cover portions 625, as measured from the horizontal displacement of the distal end of extension 682 of one to cover portion 625 to the horizontal displacement of the edge of the base 681 of the adjacent cover portion 625.

If there are multiple cover portions 625 disposed on the enclosure cover 602, such cover portions 625 can be spaced equidistantly from each other. Alternatively, the space between adjacent cover portions 625 can vary. Similarly, if there are multiple body portions 635 disposed on the enclosure body 604, such body portions 635 can be spaced equidistantly from each other. Alternatively, the space between adjacent body portions 635 can vary. In any case, the disposition of cover portions 625 on the enclosure cover 602 can correspond to the disposition of body portions 635 on the enclosure body 604. In certain example embodiments, the number of body portions 635 is different than the number of cover portions 625. The number, spacing, shape, size, and contour of the body portions 635 and the cover portions 625 can require a particular orientation of the enclosure cover 602 relative to the enclosure body 604 when the enclosure cover 602 couples to the enclosure body 604. Alternatively, the number, spacing, shape, size, and contour of the body portions 635 and the cover portions 625 can be such that no particular orientation of the enclosure cover 602 relative to the enclosure body 604 is required when the enclosure cover 602 is coupled to the enclosure body 604.

When each cover portion 625 of the fastening features 610 is disposed in each body portion 635 of the fastening features 610, the enclosure cover 602 can be secured to the enclosure body 604 by rotating the enclosure cover 602 and/or the enclosure body 604 in such a way that the extension 672 is drawn toward the extension 682 (put the fastening features 610 in an engaged position). In such a case, the extension 672 and the extension 682 abut against each other. As a result, if the angle between the extension 672 and the base 671 (and, necessarily, the angle between the extension 682 and the base 681) is obtuse, a downward force is applied to the enclosure cover 602 relative to the enclosure body 604. Consequently, the proper flame path 669, which begins inside the cavity 650 where the beveled edges 623, 633 of the cover flange 622 and the body flange 632, respectively, meet, is realized.

To decouple the enclosure cover 602 from the enclosure body 604 (put the fastening features 610 in a disengaged position), one or both can be rotated in such a manner that the extension 672 separates from the extension 682 (i.e., in the opposite direction used to couple the enclosure cover 602 to the enclosure body 604). In certain example embodiments, the enclosure cover 602 and/or the enclosure body 604 can include one or more features (e.g., notches, slots, recesses) disposed on an outer surface that can assist a user, with or without the use of a tool, in coupling and/or decoupling the enclosure cover 602 and the enclosure body 604.

In certain example embodiments, the extension 672 and/or the extension 682 can include one or more features (e.g., ridges, notches) on the surface facing the opposing extension to maintain the enclosure cover 602 and the enclosure body 604 in a coupled position. In addition, or in the alternative, one or more wedges (not shown) can be inserted into the gap 691 that remains between the base 681 and the base 671 when the enclosure cover 602 is coupled to the enclosure body 602. If there are multiple wedges, such wedges can be separate, discrete pieces, or pieces that are coupled to each other by a common joining element.

The example fastening device (and, thus, potentially the fastening feature) can also have other features, shapes, and/or sizes than those shown and described above. For example, the fastening device can be one or more of a number of bolts that are disposed within an aperture that traverses all of the cover flange and at least a portion of the body flange. In such a case, with the beveled edges of the cover flange and the body flange, respectively, could reduce the number of fastening devices needed to create and maintain the flame path between the cover flange and the body flange.

As another example, the fastening device can be a hinged clamp, such as is used with a number of pressure cookers. In such a case, the fastening device can be a separate piece, independent of the enclosure cover and the enclosure flange. Alternatively, the fastening device can be mechanically (e.g., hingedly, rotatably) coupled to the cover flange and/or the body flange. The cover flange and/or the body flange can also include one or more features (e.g., tabs, extensions) for receiving and securing the fastening device. Again, the beveled edges of the cover flange and the body flange, respectively, could reduce the number of fastening devices needed to create and maintain the flame path between the cover flange and the body flange.

Figure 7A:
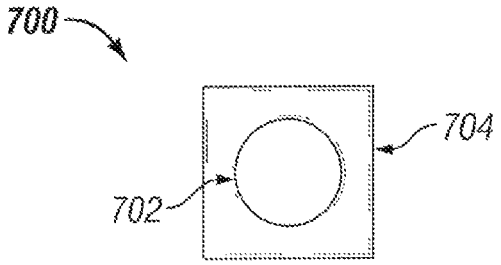
FIGS. 7A-7C show top views of various enclosures and enclosure systems with which example fastening features can be used in accordance with certain example embodiments.
Figure 7B:
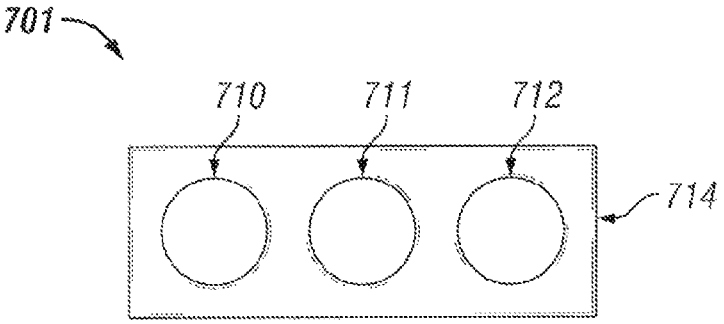
Figure 7C:
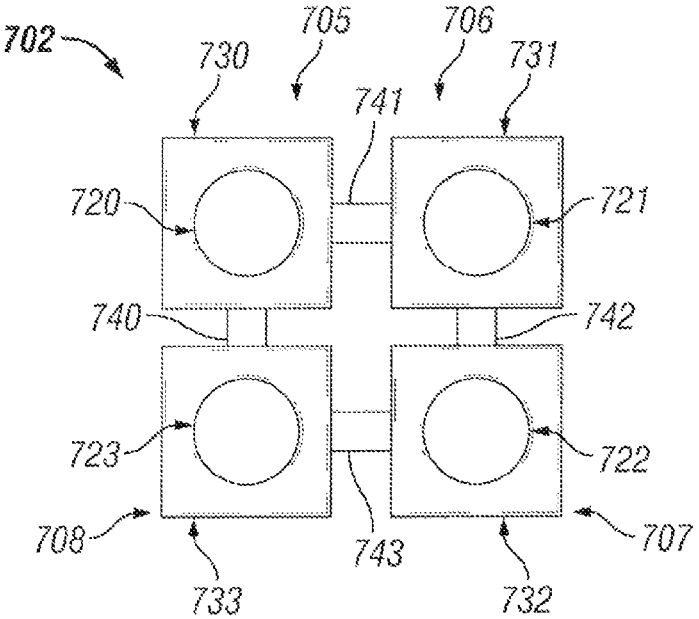

FIGS. 7A-7C show top views of various enclosures and enclosure systems with which example fastening features can be used in accordance with certain example embodiments. Specifically, FIG. 7A shows a top view of an example enclosure 700. FIG. 7B shows a top view of another example enclosure 701. FIG. 7C shows a top view of yet another example enclosure 702. In one or more embodiments, one or more of the features shown in FIGS. 7A-7C may be omitted, added, repeated, and/or substituted. Accordingly, embodiments of enclosures with example fastening features should not be considered limited to the specific arrangement of components shown in FIGS. 7A-7C.

Referring to FIGS. 1A-7C, the fastening features, such as those shown and described in FIGS. 1A-5B, are not shown to simplify the drawings. However, although not shown, each enclosure cover (e.g., enclosure cover 702, enclosure cover 711, enclosure cover 722) shown in FIGS. 7A-7C includes one or more engagement feature and, in some cases, other components of an example fastening feature described herein. Similarly, although not shown, each enclosure body (e.g., enclosure body 704, enclosure body 714, enclosure body 731) shown in FIGS. 7A-7C includes one or more engagement feature and, in some cases, other components of an example fastening feature described herein.

In FIG. 7A, the enclosure 700 includes an enclosure cover 702 that is circular from a top view (as with the enclosure cover 102 shown in FIGS. 1A-5C). The enclosure body 704 of FIG. 7A can have a square or other rectangular form from a top view, which can give the enclosure body 704 a cuboid shape. In certain example embodiments, the enclosure body 704 can have any of a number of other non-circular (from a top view) shape. In any case, the opening into the cavity of the enclosure body 704 (or more specifically, the flange of the enclosure body 704) can have a shape that is substantially similar to the flange of the enclosure cover 702. Further, while this enclosure 700 shows the enclosure cover 702 positioned substantially in the center of the top surface of the enclosure body 704, the enclosure cover 702 can be positioned at any other point on the top surface (or any other surface) of the enclosure body 704.

In FIG. 7B, there are multiple (in this case, three) enclosure covers: Enclosure cover 710, enclosure cover 711, and enclosure cover 712. Each of the enclosure covers of the enclosure 701 in FIG. 7B is mechanically coupled to one enclosure body 714. Again, each of the enclosure covers is circular when viewed from above. The enclosure body 714 in this case is rectangular from a top view, and the enclosure covers are positioned substantially equidistantly from each other in a line along the width of the enclosure body 714. Again, the enclosure body 714 can have any of a number of other shapes when viewed from above.

In any case, the multiple enclosure covers can be positioned in any arrangement on one or multiple surfaces of the enclosure body 714. Again, each opening into the cavity of the enclosure body 714 (or more specifically, the flange of the enclosure body 714) can have a shape that is substantially similar to the flange of the corresponding enclosure cover. Further, while the size of the enclosure covers shown in FIG. 7B are substantially the same size and shape, the size and/or shape of each enclosure cover can vary relative to each other.

FIG. 7C shows an enclosure system 702 that includes multiple (in this example, four) enclosures that are substantially similar to the enclosure 700 shown above in FIG. 7A. Specifically, enclosure 705 includes enclosure cover 720 and enclosure body 730. Enclosure 706 includes enclosure cover 721 and enclosure body 731. Enclosure 707 includes enclosure cover 722 and enclosure body 732. Enclosure 708 includes enclosure cover 723 and enclosure body 733.

In this example, each enclosure in the enclosure system 702 is connected to each other using joining feature (e.g., conduit) or some similar coupling component. Joining feature can allow for the transfer of cables, conductors, and/or other wires between adjoining enclosures. Here, joining feature 741 is mechanically coupled to enclosure 705 and enclosure 706. Joining feature 742 is mechanically coupled to enclosure 706 and enclosure 707. Joining feature 743 is mechanically coupled to enclosure 707 and enclosure 708. Joining feature 740 is mechanically coupled to enclosure 705 and enclosure 708.

In certain example embodiments, when a joining feature is a separate piece that is mechanically coupled to one or more enclosures, the joining feature forms a flame path with each enclosure to which the joining feature is mechanically coupled. If a joining feature is formed from a single piece (as from a mold) with one or more enclosures, then there is no flame path because there is no penetration through the enclosure or joining feature that provides a path to the exterior of the enclosure or joining feature. The size and/or shape of each enclosure cover and/or enclosure body, the number enclosures, the arrangement of the joining features, the spacing of the enclosures, and/or other aspects of the enclosure system 702 can vary from those shown in FIG. 7C.

Example embodiments of fastening devices for explosion-proof enclosures resist explosion and/or hydrostatic forces by maintaining a flame path where the cover flange and the body flange are coupled. Further, using the example fastening features (including example fastening devices) described herein and other embodiments of these example fastening features allows for efficient and effective coupling and/or decoupling of the cover and the body of an explosion-proof enclosure. Further, using example embodiments of fastening features for explosion-proof enclosures allows the flame path to comply with one or more standards and/or regulations for explosion-proof enclosures.

Example embodiments include beveled flanges for the enclosure cover and enclosure body. By having beveled flanges, the gap that forms the flame path is reduced. In addition, the beveled flanges provide self-alignment between the enclosure cover and the enclosure body. Using example fastening features with beveled flanges, the required force applied by the fastening features is reduced. Further, the amount of material used for the enclosure cover and/or the enclosure body can be reduced, saving costs and material, while still complying with one or more standards and/or regulations for explosion-proof enclosures.

Accordingly, many modifications and other embodiments set forth herein will come to mind to one skilled in the art to which fastening devices for explosion-proof enclosures pertain having the benefit of the teachings presented in the foregoing descriptions and the associated drawings. Therefore, it is to be understood that fastening devices for explosion-proof enclosures is not to be limited to the specific embodiments disclosed and that modifications and other embodiments are intended to be included within the scope of this application. For example, a fastening device does not need to include a bracket and/or a cam. Although specific terms are employed herein, they are used in a generic and descriptive sense only and not for purposes of limitation.

What is claimed is:

1. An enclosure comprising:

a top enclosure portion comprising a central portion, a top flange, and a first top engagement feature, wherein the first top engagement feature is a planar extension of the central portion, wherein the central portion has a thickness defined between a top surface and a bottom surface of the central portion;

a bottom enclosure portion mechanically coupled to the top enclosure portion, wherein the bottom enclosure portion comprises a bottom flange that mechanically couples to the top flange and a first bottom engagement feature that mechanically couples to the first top engagement feature; and a first fastening device mechanically coupled to the first top engagement feature and the first bottom engagement feature, wherein the first fastening device has a length disposed substantially perpendicular to the thickness of the central portion of the top enclosure portion, wherein the first fastening device rotates about the length between an engaged position and a disengaged position with respect to the first top engagement feature and the first bottom engagement feature, wherein the first fastening device, in the engaged position, creates and maintains a flame path between the top flange and the bottom flange, wherein the first fastening device, in the disengaged position, fails to maintain the flame path between the top flange and the bottom flange, wherein the flame path provides an uninterrupted path, from within a cavity formed by the top enclosure portion and the bottom enclosure portion toward an ambient environment outside of the cavity, along which one or more gases from within the cavity cool as the one or more gases travel from within the cavity toward the ambient environment outside of the cavity, and wherein the top enclosure portion and the bottom enclosure portion, when coupled to each other by the first fastening device, contain an explosion that originates within the cavity.

2. The enclosure of claim 1, wherein the bottom flange comprises at least one beveled edge, and wherein the top flange comprises at least one complementary beveled edge.

3. The enclosure of claim 2, wherein the at least one complementary beveled edge is disposed within a bottom surface of the top enclosure portion.

4. The enclosure of claim 1, wherein the top enclosure portion further comprises a second top engagement feature, and wherein the bottom enclosure portion further comprises a second bottom engagement feature that mechanically couples to the second top engagement feature.

5. The enclosure of claim 4, wherein the second top engagement feature is disposed on a substantially opposite end of the top enclosure portion than the first top engagement feature.

6. The enclosure of claim 4, further comprising:

a second fastening device mechanically and movably coupled to the second top engagement feature and the second bottom engagement feature.

7. The enclosure of claim 1, wherein the first fastening device comprises a first oblong section positioned toward a distal end of the first fastening device and a second oblong section positioned toward a proximal end of the first fastening device.

8. The enclosure of claim 7, wherein the first fastening device further comprises a cap disposed at the proximal end, wherein the cap controls a lateral position of the first fastening device relative to the first top engagement feature and the first bottom engagement feature.

9. The enclosure of claim 8, wherein the first fastening device further comprises a keyhole disposed between the first oblong section and the second oblong section.

10. The enclosure of claim 9, wherein the first top engagement feature comprises a keyway, wherein the keyhole is accessible in the keyway when the first fastening device is mechanically coupled to the first top engagement feature and the first bottom engagement feature.

11. The enclosure of claim 10, wherein the keyway allows the keyhole to rotate less than 360°.

12. The enclosure of claim 11, wherein rotation of the keyhole in the keyway moves the first fastening device between the engaged position and the disengaged position.

13. The enclosure of claim 12, wherein the rotation of the keyhole in the keyway is performed using a tool that fits into the keyhole.

14. The enclosure of claim 1, wherein the first top engagement feature comprises at least one first aperture, wherein the first bottom engagement feature comprises at least one second aperture that aligns with the at least one first aperture when the top enclosure portion is mechanically coupled to the bottom enclosure portion.

15. The enclosure of claim 14, wherein the at least one second aperture comprises a pair of second apertures, wherein the first fastening device is disposed within the at least one first aperture and the pair of second apertures, wherein the first fastening device comprises a first oblong section and a second oblong section that are disposed within the pair of second apertures.

16. The enclosure of claim 1, wherein the top enclosure portion is substantially circular when viewed from above.

17. The enclosure of claim 1, wherein the top enclosure portion is one of a plurality of top enclosure portions, wherein each of the plurality of top enclosure portions is mechanically coupled to the bottom enclosure portion.

18. An enclosure system, comprising:

a first enclosure, wherein the first enclosure comprises:

a first top enclosure portion comprising a first top central portion, a first top flange, and a first top engagement feature, wherein the first top engagement feature is a first planar extension of the first central portion, wherein the first top central portion has a first thickness defined between a first top surface and a first bottom surface of the first top central portion;

a first bottom enclosure portion mechanically coupled to the top enclosure portion, wherein the first bottom enclosure portion comprises a first bottom flange that mechanically couples to the first top flange and a first bottom engagement feature that mechanically couples to the first top engagement feature; and a first fastening device mechanically coupled to the first top engagement feature and the first bottom engagement feature, wherein the first fastening device has a first length disposed substantially perpendicular to the first thickness of the first top central portion of the first top enclosure portion, wherein the first fastening device rotates about the first length between an engaged position and a disengaged position with respect to the first top engagement feature and the first bottom engagement feature, wherein the first fastening device, in the engaged position, maintains a first flame path between the first top flange and the first bottom flange, and wherein the first fastening device, in the disengaged position, fails to maintain the first flame path between the first top flange and the first bottom flange, wherein the first flame path provides a first uninterrupted path, from within a first cavity formed by the first top enclosure portion and the first bottom enclosure portion toward an ambient environment outside of the first cavity, along which one or more first gases from within the first cavity cool as the one or more first gases travel from within the first cavity toward the ambient environment outside of the first cavity, and wherein the first top enclosure portion and the first bottom enclosure portion, when coupled to each other by the first fastening device, contain a first explosion that originates within the first cavity;

a second enclosure, wherein the second enclosure comprises:

a second top enclosure portion comprising a second top central portion, a second top flange, and a second top engagement feature, wherein the second top engagement feature is a second planar extension of the second central portion, wherein the second top central portion has a second thickness defined between a second top surface and a second bottom surface of the second top central portion;

a second bottom enclosure portion mechanically coupled to the second top enclosure portion, wherein the second bottom enclosure portion comprises a second bottom flange that mechanically couples to the second top flange and a second bottom engagement feature that mechanically couples to the second top engagement feature; and a second fastening device mechanically coupled to the second top engagement feature and the second bottom engagement feature, wherein the second fastening device has a second length disposed substantially perpendicular to the second thickness of the second top central portion of the second top enclosure portion, wherein the second fastening device rotates about the second length between the engaged position and the disengaged position with respect to the second top engagement feature and the second bottom engagement feature, wherein the second fastening device, in the engaged position, maintains a second flame path between the second top flange and the second bottom flange, and wherein the second fastening device, in the disengaged position, fails to maintain the second flame path between the second top flange and the second bottom flange, wherein the second flame path provides a second uninterrupted path, from within a second cavity formed by the second top enclosure portion and the second bottom enclosure portion toward the ambient environment outside of the second cavity, along which one or more second gases from within the second cavity cool as the one or more second gases travel from within the second cavity toward the ambient environment outside of the second cavity, and wherein the second top enclosure portion and the second bottom enclosure portion, when coupled to each other by the second fastening device, contain a second explosion that originates within the second cavity; and a joining feature mechanically coupled to the first enclosure and the second enclosure, wherein the joining feature forms a third flame path with the first enclosure and a fourth flame path with the second enclosure.

19. The enclosure system of claim 18, wherein the joining feature is a conduit.

* * * * *